US008057192B2

(12) United States Patent
Page, Jr. et al.

(10) Patent No.: US 8,057,192 B2
(45) Date of Patent: Nov. 15, 2011

(54) CYCLIC CONDENSATE PUMP HAVING A THREE-WAY VALVE

(75) Inventors: George W. Page, Jr., Cornwall, NY (US); Dan Walter Cole, Burlingham, NY (US)

(73) Assignee: Spence Engineering Company, Inc., Walden, NY (US)

( * ) Notice: Subject to any disclaimer, the term of this patent is extended or adjusted under 35 U.S.C. 154(b) by 504 days.

(21) Appl. No.: 12/362,619

(22) Filed: Jan. 30, 2009

(65) Prior Publication Data

US 2009/0129958 A1 May 21, 2009

Related U.S. Application Data

(63) Continuation-in-part of application No. 11/113,593, filed on Apr. 25, 2005, now Pat. No. 7,491,035.

(51) Int. Cl.
*F04F 1/06* (2006.01)
*F16K 1/06* (2006.01)

(52) U.S. Cl. ..... 417/128; 417/130; 417/131; 137/413

(58) Field of Classification Search ..... 417/128, 417/130, 131, 134; 137/413
See application file for complete search history.

(56) References Cited

U.S. PATENT DOCUMENTS 832,394 A * 10/1906 Latta et al. ..... 417/125
3,856,035 A * 12/1974 Fujiwara ..... 137/413
3,972,650 A * 8/1976 Brennan ..... 417/128
4,025,236 A * 5/1977 Fujiwara ..... 417/128
5,141,405 A 8/1992 Francart, Jr.
5,366,349 A 11/1994 Ilg
5,401,142 A 3/1995 Yumoto
5,445,501 A 8/1995 Yumoto
5,655,888 A 8/1997 Yumoto
5,755,560 A 5/1998 Yumoto
5,941,691 A 8/1999 Stephens
6,095,759 A 8/2000 Breslin
6,244,829 B1 6/2001 Yumoto
6,634,891 B1 10/2003 Cheng

* cited by examiner

*Primary Examiner* — Charles Freay
(74) *Attorney, Agent, or Firm* — McNees Wallace & Nurick LLC

(57) ABSTRACT

A condensate pump includes a condensate reservoir, a liquid level float sensor operable to sense a liquid level within the condensate reservoir, and a pressure/vent valve including a pressure source, a pressure vent, and a primary piston slidably supported in a primary cylinder and sliding in the primary cylinder responsive to the liquid level sensor. A secondary piston is slidably supported in a secondary cylinder and moves responsive to a movement of the primary piston between a first secondary-piston position wherein the pressure source is in communication with a gas space of the condensate reservoir and the pressure vent is isolated from the gas space, and a second secondary-piston position wherein the pressure source is isolated from the gas space and the pressure vent is in communication with the gas space. An aperture in the primary piston and passages may also be provided to prevent build-up of gas pressures and maintain pressures in preselected regions within the pump at atmospheric pressures.

21 Claims, 9 Drawing Sheets

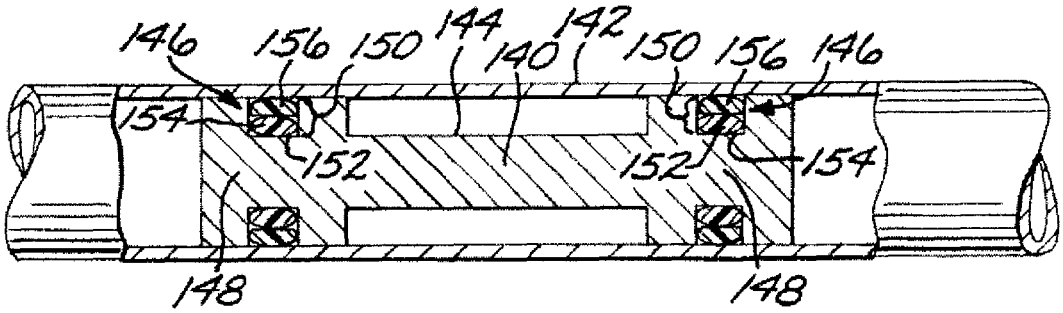
FIG. 6
FIG. 5
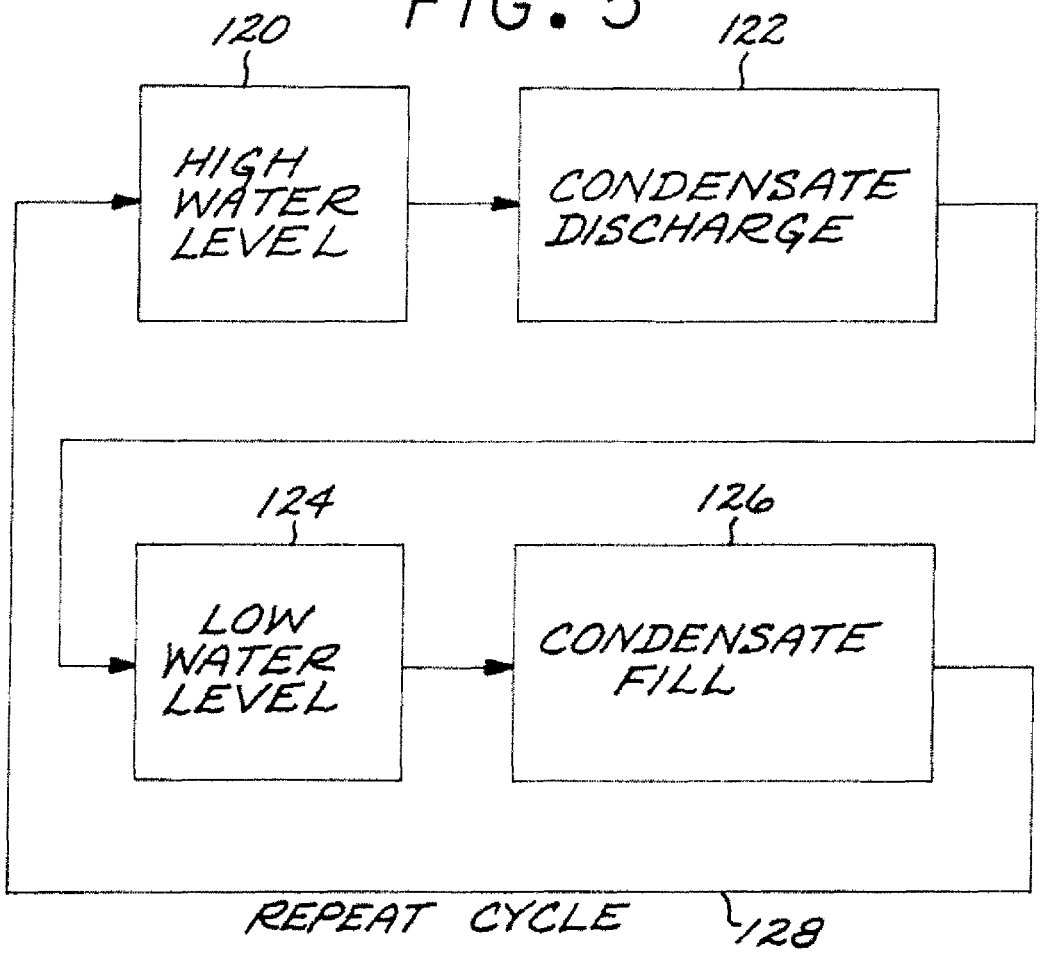

CYCLIC CONDENSATE PUMP HAVING A THREE-WAY VALVE

This invention relates to a condensate pump, and more particularly to a condensate pump that is switched through piston action rather than with a spring mechanism and seated valves.

BACKGROUND OF THE INVENTION

Many industrial applications produce steam, employ the steam in a process or apparatus, and condense the steam back to water. The condensate water is typically recycled back to the steam production in a closed cycle, rather than being discharged. The recycling of the condensate is undertaken because the water may be treated with expensive chemicals that would be lost if the water were discharged, because the discharge of the water could have adverse environmental consequences, and because the heat of the hot water would be lost if it were discarded.

To recycle the condensate, it is accumulated in a condensate reservoir and pumped back to the boiler under pressure. Condensate water enters the reservoir until the reservoir is nearly full, and then the condensate is pumped out of the reservoir by a compressed gas such as steam or compressed air. At the completion of the pump-out when the liquid level is low, the reservoir is vented, and the accumulation process repeats.

A number of different approaches have been utilized for the pump used in conjunction with the condensate reservoir. Historically and in the majority of current applications, a centrifugal pump is used. More recently, the steam-pumping trap has been introduced. The steam-pumping trap typically employs a spring-loaded overcenter trap or other type of mechanism to open and close the pressure and vent valves in coordination with a float that senses the liquid level in the reservoir. The valves use a plug-and-seat configuration. While operable, such designs have associated high fabrication and maintenance costs. Additionally, the sizes of the pressure and vent ports are limited. Because of the large forces required to operate the mechanism, the float must be relatively large in size.

There is a need for an improved approach to the construction of the condensate pump that overcomes these limitations. The present invention fulfills this need, and further provides related advantages.

SUMMARY OF THE INVENTION

The present invention provides a pump that may be used for condensate pumping. No high-fabrication and high-maintenance spring-loaded mechanism is used, reducing both the initial and maintenance costs. The sizes of the ports that may be used are larger than those used with conventional plug-and-seat valves, allowing faster cycling times and/or a larger condensate reservoir than possible with conventional pumps. The size of the float that is the preferred liquid-level sensor is reduced.

In accordance with the invention, a condensate pump comprises a condensate reservoir having a fluid inlet, an inlet check valve operable to prevent a flow of fluid out of the condensate reservoir through the fluid inlet and to allow a flow of fluid into the condensate reservoir through the fluid inlet, a fluid outlet, and an outlet check valve operable to prevent a flow of fluid into the condensate reservoir through the fluid outlet and to allow a flow of fluid out of the condensate reservoir through the fluid outlet. A liquid level sensor is operable to sense a liquid level within the condensate reservoir. A pressure/vent valve comprises a pressure source, a pressure vent, and a three-way valve preferably including a secondary piston that is slidably supported in a secondary cylinder. The secondary piston slides in the secondary cylinder responsive to the liquid level sensor, between a first secondary-piston position wherein the pressure source is in communication with a gas space of the condensate reservoir and the pressure vent is isolated from the gas space, and a second secondary-piston position wherein the pressure source is isolated from the gas space and the pressure vent is in communication with the gas space. Preferably, the secondary piston is double ended with a spool configuration. The pressure/vent valve may be located exterior to the condensate reservoir or within the condensate reservoir, but is preferably located exterior to the condensate reservoir for ease of installation and maintenance.

In one embodiment, a reservoir pressurization line extends from the pressure source to a first intermediate position of the secondary cylinder, a reservoir vent line extends from the vent to a second intermediate location of the secondary cylinder, and a pressurization/vent line extends from a third intermediate location of the secondary cylinder to the gas space of the condensate reservoir.

The secondary piston operates responsive to the liquid level sensor, preferably responsive to a movement of the liquid level sensor. The responsive movement is preferably accomplished through a primary piston slidably supported in a primary cylinder. The primary piston slides in the primary cylinder responsive to the liquid level sensor, between a first primary-piston position and a second primary-piston position. The secondary piston slides in the secondary cylinder responsive to the movement of the primary piston. Preferably, the liquid level sensor comprises a float within the condensate reservoir, and an actuating arm connected to the float and movable with the float. The actuating arm is connected to the primary piston. In this embodiment, there is preferably a main pressure drive line extending from the pressure source to an intermediate location of the primary cylinder, a first branch pressure drive line extending from a first intermediate location of the primary cylinder to a first end of the secondary cylinder, and a second branch pressure drive line extending from a second intermediate location of the primary cylinder to a second end of the secondary cylinder.

In a most preferred embodiment, a condensate pump comprises a condensate reservoir having a fluid inlet, an inlet check valve operable to prevent a flow of fluid out of the condensate reservoir through the fluid inlet and to allow a flow of fluid into the condensate reservoir through the fluid inlet, a fluid outlet, and an outlet check valve operable to prevent a flow of fluid into the condensate reservoir through the fluid outlet and to allow a flow of fluid out of the condensate reservoir through the fluid outlet. A liquid level sensor is operable to sense a liquid level within the condensate reservoir. The liquid level sensor comprises a float within the condensate reservoir, and an actuating arm connected to the float and movable with the float. A pressure/vent valve is located exterior to the condensate reservoir and comprises a pressure source and a pressure vent. The pressure/vent valve includes a primary piston slidably supported in a primary cylinder. The primary piston is double ended in a primary-piston spool configuration. The primary piston slides in the primary cylinder responsive to the liquid level sensor, between a first primary-piston position and a second primary-piston position. The actuating arm is connected to the primary piston. The pressure/vent valve further includes a secondary piston slidably supported in a secondary cylinder, wherein the secondary piston is double ended in a secondary piston spool configuration. The secondary piston slides in the secondary cylinder between a first secondary-piston position wherein the pressure source is in communication with a gas space of the condensate reservoir and the pressure vent is isolated from the gas space, and a second secondary-piston position wherein the pressure source is isolated from the gas space and the pressure vent is in communication with the gas space. A drive pressurization structure includes a main pressure drive line extending from the pressure source to an intermediate location of the primary cylinder, a first branch pressure drive line extending from a first intermediate location of the primary cylinder to a first end of the secondary cylinder, and a second branch pressure drive line extending from a second intermediate location of the primary cylinder to a second end of the secondary cylinder. A reservoir pressurization/vent structure includes a reservoir pressurization line extending from the pressure source to a first intermediate location of the secondary cylinder, a reservoir vent line extending from the vent to a second intermediate location of the secondary cylinder, and a pressurization/vent line extending from a third intermediate location of the secondary cylinder to the gas space of the condensate reservoir.

The condensate pump of the invention is readily constructed, and is reliable and readily maintained in service. The gas-flow structure of the present design may be implemented in a cast-block configuration, for low cost. Because pressure and vent connections are made with pistons rather than plug-and-seat type valves, the pressure and vent gas-flow channels may be made large so that they have high flow rates.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 5 is a block diagram of a discharge/fill cycle for the condensate pump; and FIG. 6 is an enlargement of a piston illustrating the sealing structure.

DETAILED DESCRIPTION OF THE INVENTION

Figure 1:
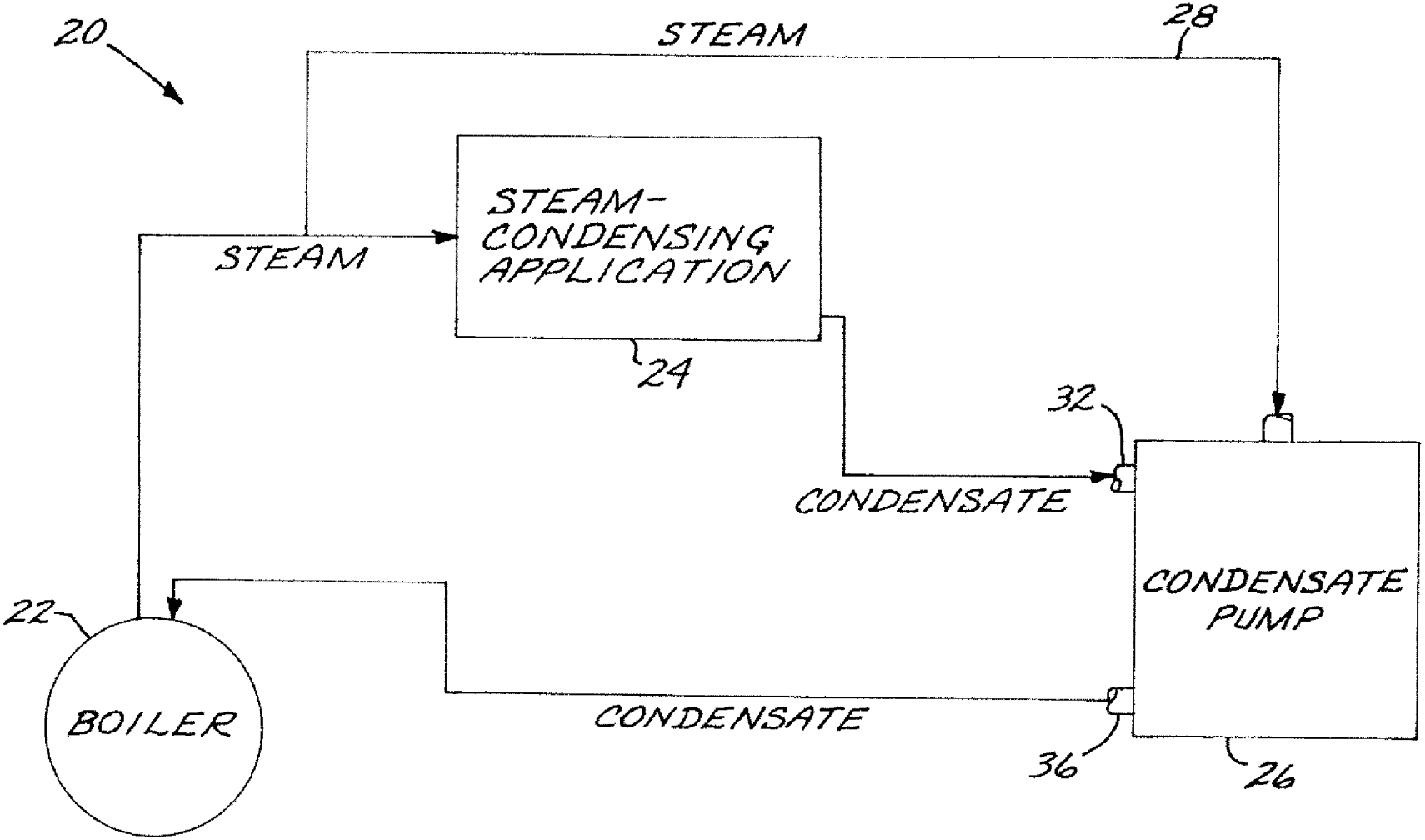
FIG. 1 is a schematic diagram of a steam system.

FIG. 1 depicts a steam system 20 in which a boiler 22 produces pressurized steam. The pressurized steam is supplied to a steam-condensing application 24, such as a steam engine or a heat exchanger. Condensate from the steam-condensing application 24 is supplied to a condensate pump 26, which accumulates the condensate and then pumps it back to the boiler 22 under pressure. In the illustrated embodiment, pressurized steam 28 is also supplied directly to the condensate pump 26 for use as will be described subsequently. As used herein, the "condensate" may be liquid water but may also include some steam (gaseous water), and is described generally as a fluid, inasmuch as "fluid" includes both a gas and a liquid.

Figure 2:
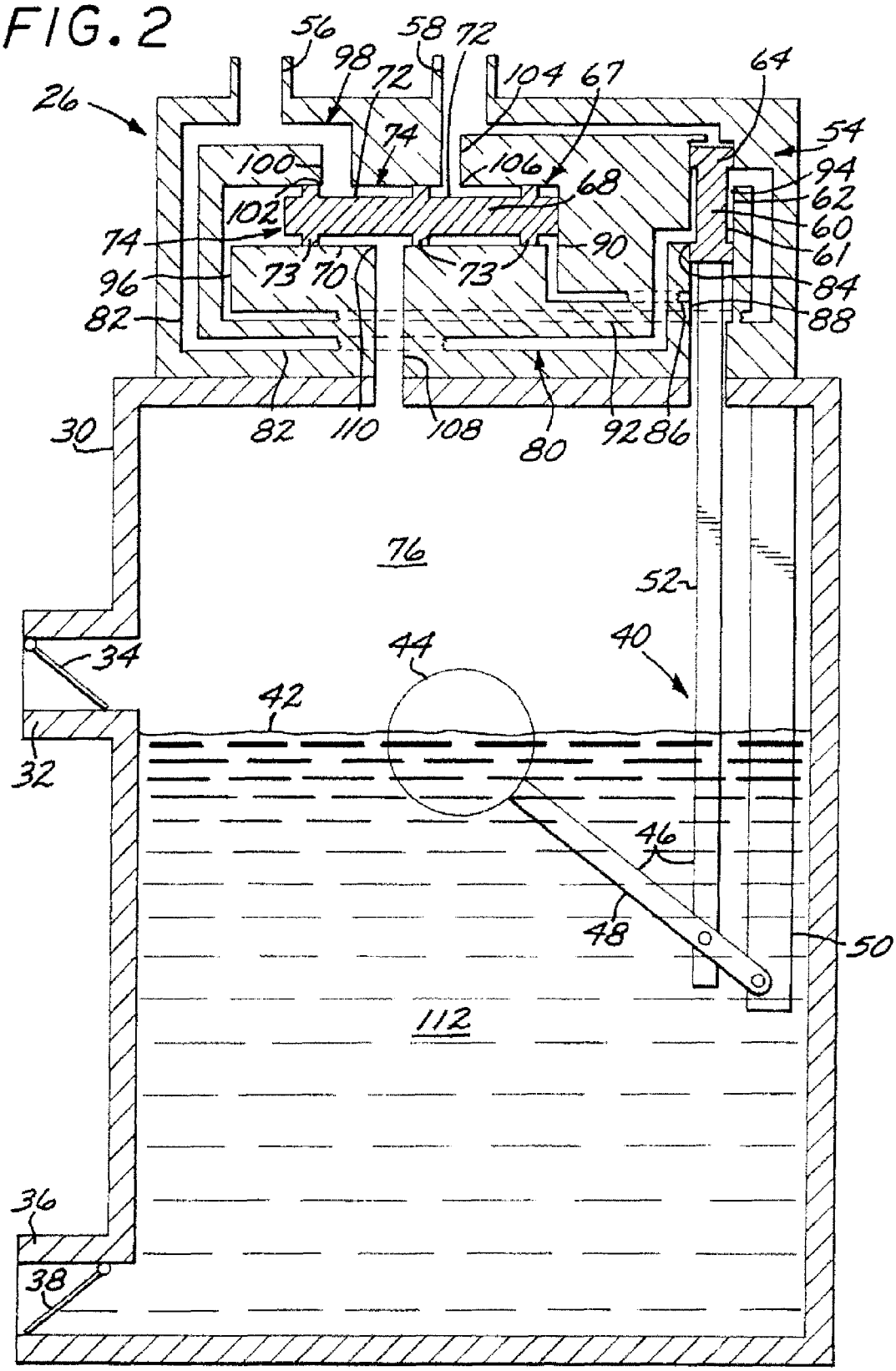
FIG. 2 is a schematic sectional view of a first embodiment of the condensate pump with a high water level in the condensate reservoir.
Figure 3:
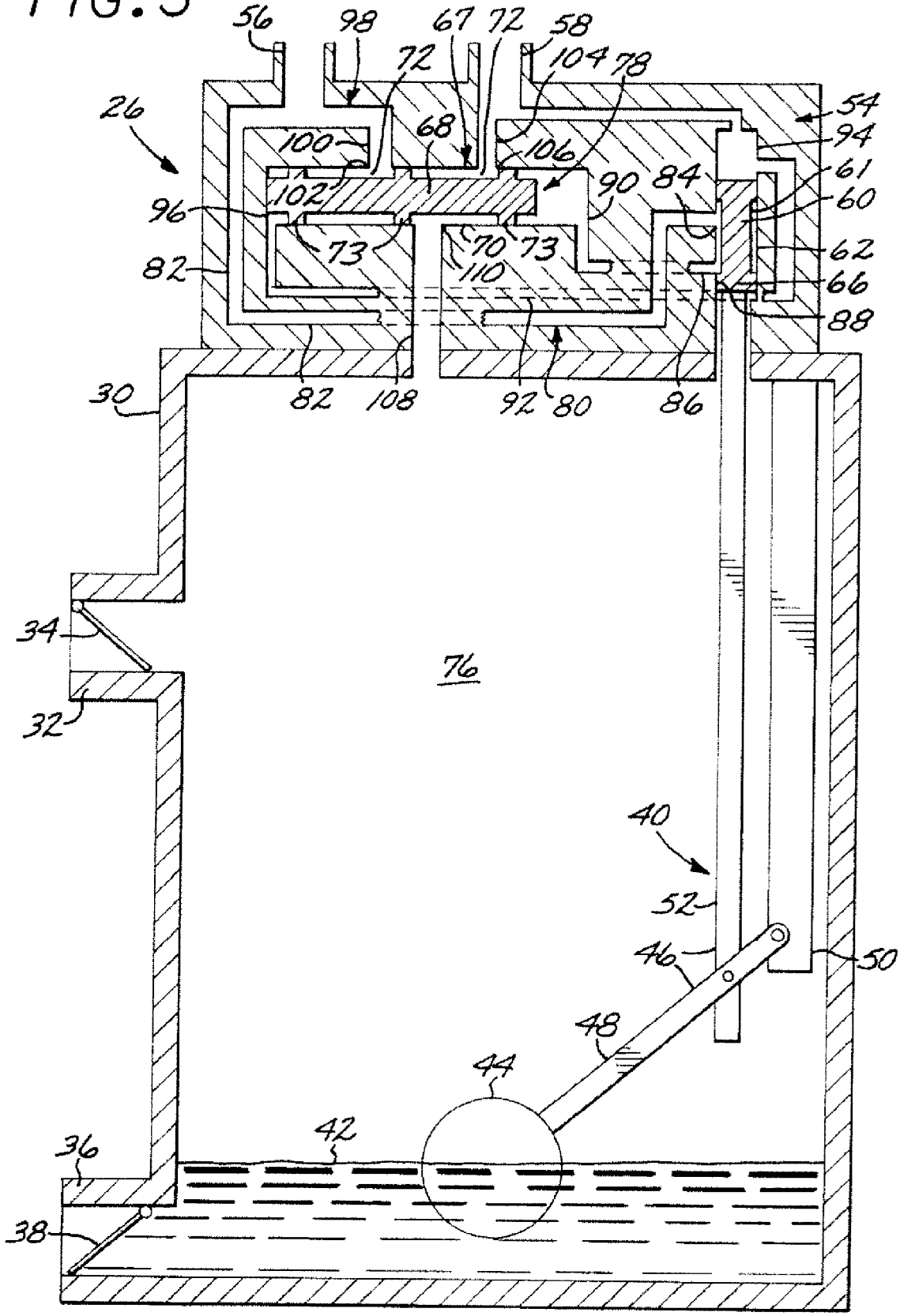
FIG. 3 is a schematic sectional view of the first embodiment of the condensate pump with a low water level in the condensate reservoir.
Figure 4:
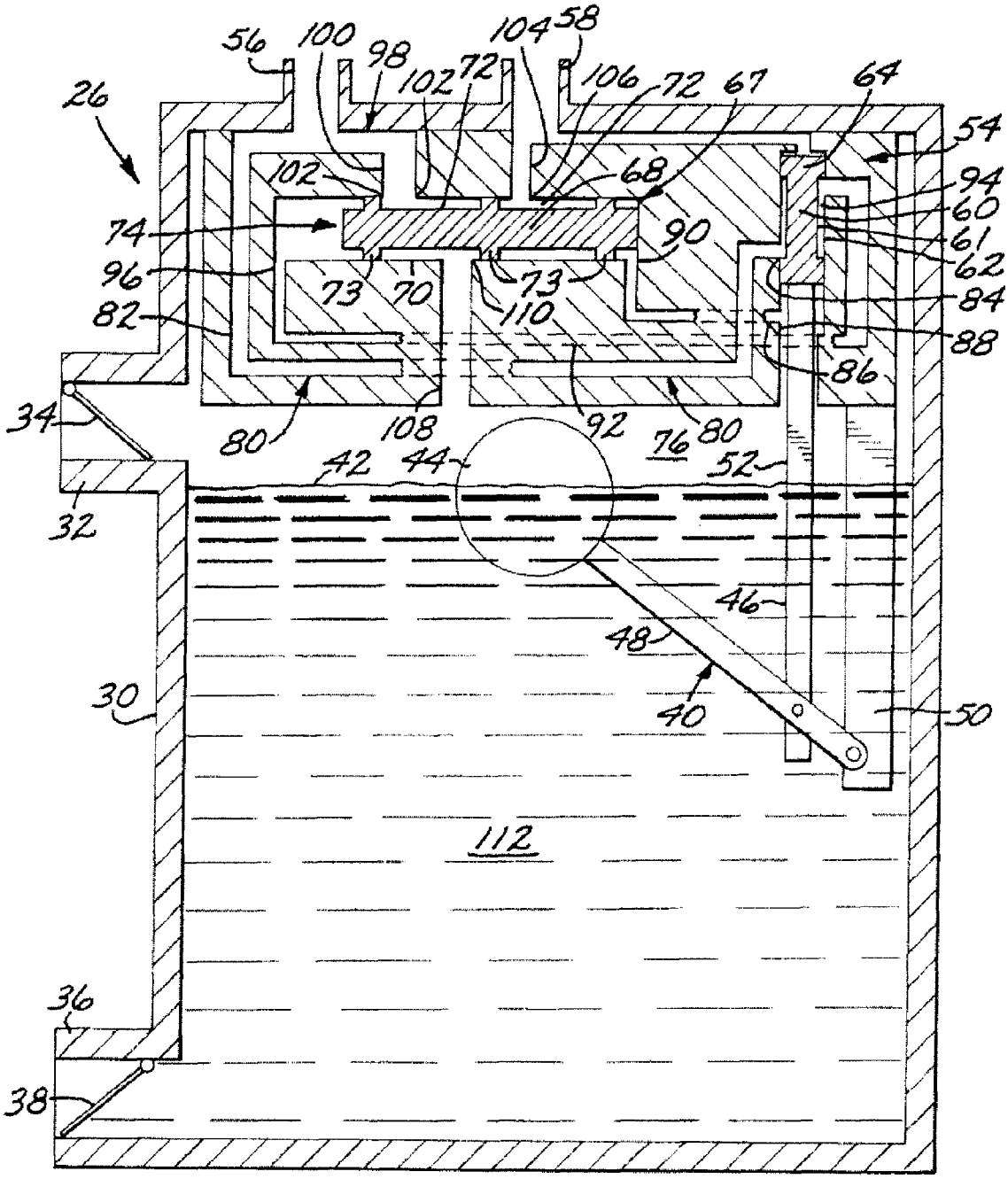
FIG. 4 is a schematic sectional view of a second embodiment of the condensate pump with a high water level in the condensate reservoir.

FIGS. 2-3 depict in greater detail a first embodiment of the condensate pump 26, and FIG. 4 depicts a second embodiment of the condensate pump 26. In each embodiment, the condensate pump 26 includes a condensate reservoir 30 that is a closed vessel except for openings therethrough as will be discussed. The condensate reservoir 30 has a fluid inlet 32 and an inlet check valve 34 therein oriented to prevent a flow of fluid out of the condensate reservoir 30 through the fluid inlet 32 and to allow a flow of fluid into the condensate reservoir 30 through the fluid inlet 32. The condensate pump 26 further includes a fluid outlet 36, and an outlet check valve 38 therein oriented to prevent a flow of fluid into the condensate reservoir 30 through the fluid outlet 36 and to allow a flow of fluid out of the condensate reservoir 30 through the fluid outlet 36.

A liquid level sensor 40 is operable to sense a liquid level 42 within the condensate reservoir 30. FIG. 2 depicts a high liquid level 42, and FIG. 3 depicts a low liquid level 42 for the first embodiment. The liquid level sensor 40 may be of any operable type. A preferred liquid level sensor includes a float 44 within the condensate reservoir 30, and an actuating arm 46 connected to the float 44 and movable with the float 44. In the illustrated embodiment, the actuating arm 46 includes a first actuating arm segment 48 that is fixed to the float 44 at one end and is pivotally attached to an actuating-arm support 50 at its other end. A second actuating arm segment 52 is pivotally attached to the first actuating arm segment 48 at an intermediate point along the length of the first actuating arm segment 48, and moves vertically with the rising and falling of the float 44.

The condensate pump 26 further includes a pressure/vent valve 54. In the first embodiment of FIGS. 2-3, the pressure/vent valve 54 is located exterior to the condensate reservoir 30. In the second embodiment of FIG. 4, the pressure/vent valve 54 is located within the condensate reservoir 30. The embodiment of FIGS. 2-3 is preferred, as the exterior pressure/vent valve 54 is more readily installed and maintained than the internal pressure/vent valve 54 of FIG. 4. The pressure/vent valve 54 is most preferably fabricated as an integral structure with passageways therein, see FIGS. 2-4, as may be produced by casting and machining processes. The pressure/vent valve 54 may also be fabricated as a set of interconnected discrete elements, which is less preferred because of the greater costs. The embodiments of FIGS. 2-3 and 4 are otherwise similar, and the following description applies to both embodiments. The low-level state of the second embodiment of FIG. 4 is not separately illustrated, as it is otherwise the same as the low-level state of FIG. 3.

The pressure/vent valve 54 includes a pressure source 56 and a pressure vent 58 to atmosphere. The pressure source 56 may be of any operable type, but is preferably the pressurized steam 28 shown in FIG. 1. The use of pressurized steam, from the same source as the condensate, as the pressure source avoids any possible contamination of the condensate within the condensate pump 26. However, other types of pressure sources, such as a pressurized air source, may be used as well.

The pressure/vent valve 54 has a primary piston 60 that is slidably supported in a primary cylinder 62. The primary piston 60 is of any operable configuration, but is preferably double ended in a primary-piston spool configuration, with a central recess 61 extending along a portion of the length of the primary piston 60, as shown in the drawings. The primary piston 60 slides in the primary cylinder 62 responsive to the liquid level sensor 40, between a first (upper, see FIG. 2 for the first embodiment and FIG. 4 for the second embodiment) primary-piston position 64 illustrated in FIG. 2 and a second (lower, see FIG. 3) primary-piston position 66 illustrated in FIG. 3. In the preferred embodiment wherein the liquid level sensor 40 uses the structure with the float 44 and the actuating arm 46, the actuating arm 46, and specifically the second actuating arm segment 52, is connected to the primary piston 60 to effect the sliding movement within the primary cylinder 62.

The pressure/vent valve 54 further comprises a three-way valve 67 that preferably includes a secondary piston 68 slidably supported in a secondary cylinder 70. The secondary piston is of any operable configuration, but is preferably symmetrically double ended in a secondary piston spool configuration, with two central recesses 72 extending along portions of the length of the secondary piston 68 and three rings 73 defining the central recesses 72, as shown in the drawings. The secondary piston 68 slides in the secondary cylinder 70 between a first (right, see FIG. 2) secondary-piston position 74 wherein the pressure source 56 is in communication with a gas space 76 above the liquid level 42 of the condensate reservoir 30 and the pressure vent 58 is isolated from the gas space 76, and a second (left, see FIG. 3) secondary-piston position 78 wherein the pressure source 56 is isolated from the gas space 76 and the pressure vent 58 is in communication with the gas space 76.

A drive pressurization structure 80 causes the secondary piston 68 to move responsive to the movement of the primary piston 60, which in turn moves responsive to the liquid level sensor 40. The drive pressurization structure 80 includes a main pressure drive line 82 extending from the pressure source 56 to an intermediate location 84 between the ends of the primary cylinder 62, and in communication with the central recess 61 of the primary piston 60. A first branch pressure drive line 86 extends from a first intermediate location 88 of the primary cylinder 62 to a first end 90 of the secondary cylinder 70. A second branch pressure drive line 92 extends from a second intermediate location 94 of the primary cylinder 62 to a second end 96 of the secondary cylinder 70.

In operation, when the liquid level 42 is at its high point (FIGS. 2 and 4), the liquid level sensor 40 pushes the primary piston 60 upward to its first primary piston position 64. Gas pressure communication is established from the pressure source 56, through the main pressure drive line 82, through the central recess 61, through the second branch pressure drive line 92, and to the second end 96 of the secondary cylinder 70. This gas pressure forces the secondary piston 68 to the right, as seen in FIGS. 2 and 4. When the liquid level 42 is at its low point (FIG. 3), the liquid level sensor 40 pulls the primary piston 60 downward to its second primary piston position 66. Gas pressure communication is established from the pressure source 56, through the main pressure drive line 82, through the central recess 61, through the first branch pressure drive line 86, and to the first end 90 of the secondary cylinder 70. This gas pressure forces the secondary piston 68 to the left, as seen in FIG. 3.

A reservoir pressurization/vent structure 98 alternatively pressurizes and vents the gas space 76 of the condensate reservoir 30, responsive to the movement of the secondary piston 68. The reservoir pressurization/vent structure 98 includes a reservoir pressurization line 100 extending from the pressure source 56 to a first intermediate location 102 of the secondary cylinder 70. A reservoir vent line 104 extends from the vent 58 to a second intermediate location 106 of the secondary cylinder 70. A pressurization/vent line 108 extends from a third intermediate location 110 of the secondary cylinder 70 to the gas space 76 of the condensate reservoir 30.

In operation, when the secondary piston 68 is in its right position (FIGS. 2 and 4), gas communication is established from the pressure source 56, through the reservoir pressurization line 100, through the leftmost central recess 72 of the secondary piston 68, through the pressurization/vent line 108, and to the gas space 76 of the condensate reservoir 30. The liquid level 42 is forced downwardly by the gas pressure, and condensate 112 flows past the outlet check valve 38 and out of the fluid outlet 36. When the secondary piston 68 is in its left position (FIG. 3), gas venting is established from the gas space 76, through the pressurization/vent line 108, through the rightmost central recess 72 of the secondary piston 68, through the reservoir vent line 104, and to the vent 58. Gas pressure in the gas space 76 is released. When the pressure in the gas space 76 is less than that applied to the inlet 32, condensate 112 flows through the fluid inlet 32, past the inlet check valve 32, and into the condensate reservoir 30 for accumulation.

FIG. 5 depicts the steps in a cycle of the condensate pump 26. As the cycle begins, the liquid level 42 is at its high-water level, step 120, as depicted in FIGS. 2 and 4. The primary piston 60 is in its first primary piston position 64, so that gas pressure from the pressure source 56 flows to the second end 96 of the secondary cylinder 70. The secondary piston 68 moves to the right. Gas pressure then flows to the gas space 76, forcing the liquid level 42 down as condensate 112 flows out of the fluid outlet 36, step 122.

As the condensate is discharged, step 122, the liquid level 42 drops so that the primary piston 60 moves downwardly in the primary cylinder 62. As the primary piston 60 moves through the midpoint of the primary cylinder 62, both the first branch pressure drive line 86 and the second branch pressure drive line 92 are blocked, leading to balanced pressure at both ends 90, 96 of the secondary cylinder 70. Consequently, the secondary piston 68 does not move. The inlet check valve 34 prevents pressure from being reduced by gas flow out of the fluid inlet 32.

When the liquid level 42 reaches its low-water level, step 124, as depicted in FIG. 3, the primary piston 60 reaches its second primary piston position 66. Gas pressure from the pressure source 56 flows to the first end 90 of the secondary cylinder 70, forcing the secondary piston 68 to the left. The pressure in the gas space 76 is relieved as gas flows to the vent 58. Liquid begins to flow into the condensate reservoir 30 through the fluid inlet 32.

The liquid level 42 rises and the condensate reservoir 30 is gradually filled, step 126. The primary piston 60 moves through its midpoint, blocking both the first branch pressure drive line 86 and the second branch pressure drive line 92, producing a balanced pressure on the secondary piston 68 so that it does not move. When the liquid level 42 reaches its high-water level (FIGS. 2 and 4) the cycle is complete and then is repeated, step 128.

FIG. 6 depicts in general form a piston 140 in a cylinder 142. The piston 140 has the double-ended spool shape that is preferred for the primary piston 60. (A similar configuration but having three rings and three seals is used for the secondary piston 68.) To achieve a gas seal of a recess 144, gas seals 146 are present in each of the piston heads 148. Each annular seal 150 includes a seal recess 152 with an O-ring 154 in the seal recess 152, and an annulus of seal material 156 overlying the O-ring 154. The elastomeric O-ring 154 biases the seal material 156 against the inner wall of the cylinder 142 to effect a wiping seal. A preferred seal material 156 is buna rubber for air and EPDM for steam. This sealing approach may be used for both the primary piston 60 and the secondary piston 68 of the present design. Any other type of operable seal, such as a standard O-ring seal or a lip seal, may be used instead of the described seal 150.

Figure 7:
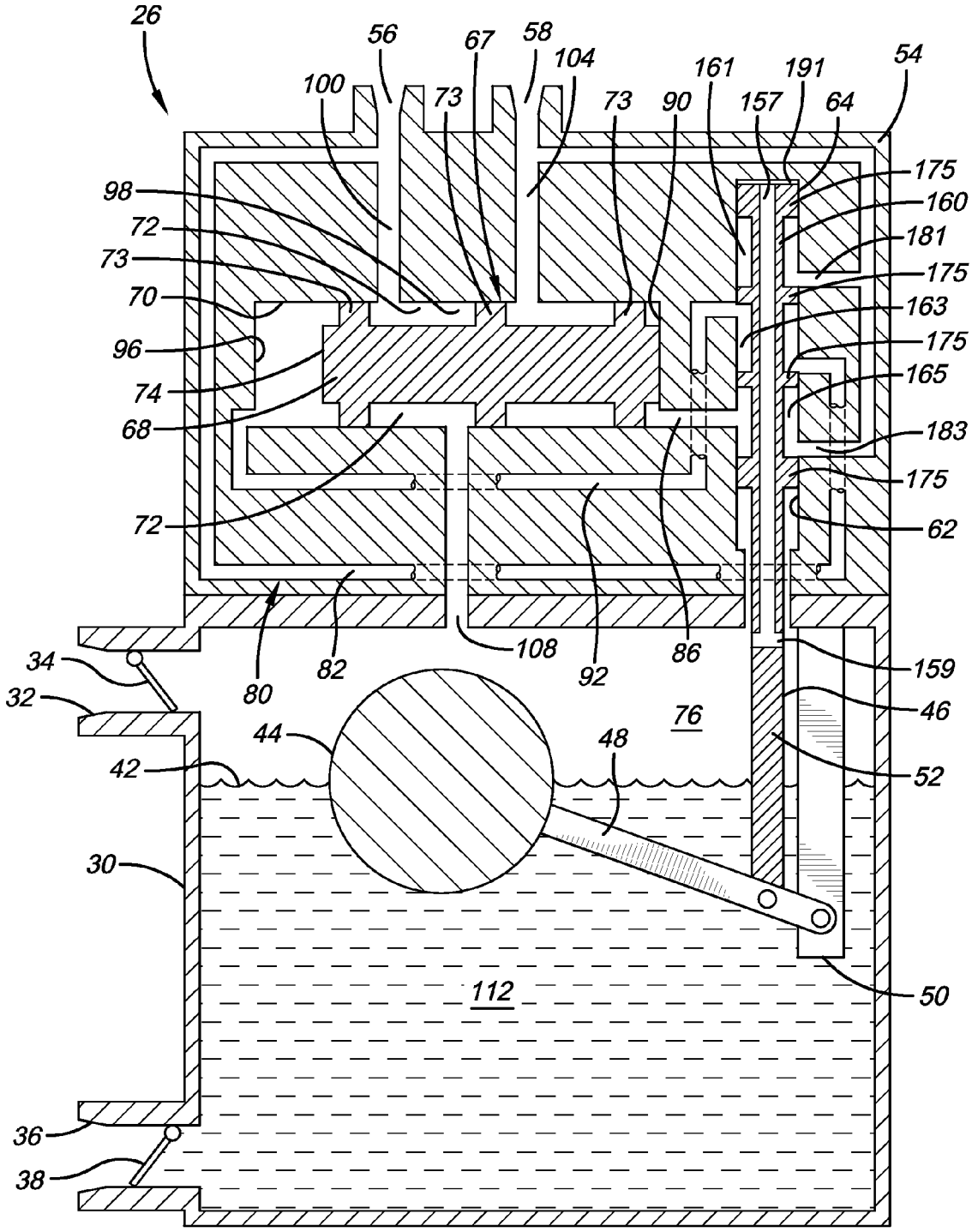
FIG. 7 is an alternate embodiment of the condensate pump of the present invention.

FIG. 7 provides another embodiment of the present invention. This embodiment provides a condensate pump that is more responsive to liquid level sensor 40 when float 44 approaches or is positioned at a liquid level 42 that is either high or low. The embodiment of FIG. 7 provides a means for allowing a fluid to escape from behind primary piston 160 as it moves between a first primary piston position 64 and a second primary piston position 66. As depicted in FIG. 7, primary piston 160 moves within primary cylinder 62 and is attached to an actuating arm 46 that is attached to float 44. Actuating arm 46 includes a first actuating arm segment 48 attached to float 44 at one end and pivotally attached to actuation-arm support 50 at the other end. A second actuating arm segment 52 is pivotally attached to the first actuating arm segment 48 at an intermediate point along the length of the first actuating arm segment 48, and moves vertically with the rising and falling of float 44. The vertical movement of second actuating arm segment 52 causes primary piston 160 to move within primary cylinder 62, either through direct connection to or indirect connection to primary cylinder 62. Primary piston 160 further includes a vertical aperture 157 that extends through primary piston 62. It also will be understood that primary piston 160 and second actuating arm segment 52 can be a single piece connected to first actuating arm segment 48, if desired. Vertical aperture 157 extends through primary piston 160 a sufficient distance so that vertical aperture 157 is in fluid communication with condensate reservoir 30 when primary piston 160 is positioned in an upward position when the liquid level is high, as shown in FIG. 8C. As shown in FIG. 7, vertical aperture 157 is in fluid communication, in a preferred embodiment, with gas space 76 through a non-vertical passageway 159 extending across primary piston 160. As shown, non-vertical passageway 159 is normal to vertical aperture 157. However, if desired, it is contemplated that no non-vertical passageway need be provided, as vertical passageway may vent into reservoir 30 through the bottom of primary piston 160, although this is not preferred.

Primary piston 160 further includes a plurality of rings or hubs 175. These rings or hubs 175 divide primary piston 160 so that it has a plurality of recesses. Rings 175 and recesses 161, 163, 165 form the outer diameter of the piston, with rings 175 having an outer diameter that is larger than the outer diameter of the recesses. The outer diameter of rings 175 closely matches the diameter of primary cylinder 62, but sufficiently smaller than that of primary cylinder 62 to allow it to slide within the diameter of primary cylinder 62 without binding. However, recesses 161,163 165 form distinct cavities isolated from one another when primary piston 160 is assembled into primary cylinder 62. If necessary, seals may be applied to rings to maintain the isolation of recesses 161, 163, 165 from one another when primary piston 160 is assembled into primary cylinder 62. In FIG. 7, four rings 175 provide primary piston 160 with three recesses, 161,163,165, each recess being positioned on the outer diameter of primary piston 160 between a pair of rings 175, adjacent pairs of rings 175 forming a top recess 161, a bottom recess 165 and an intermediate recess 163 positioned between top recess 161 and bottom recess 165, which form isolated cavities when primary piston 160 is assembled into primary cylinder 62.

Primary cylinder 62 is also connected to a plurality of passages. These passages include main pressure drive line 82, second branch pressure drive line and first branch pressure drive line 86, which provide pressurization to move primary piston 160 and secondary piston 68 as previously discussed. However, in this embodiment, additional passages are provided as upper passage 181 and lower passage 183, which are in fluid communication with pressure vent 58. These passages may permit venting of gas to pressure vent 58 as will be explained.

Figure 8A:
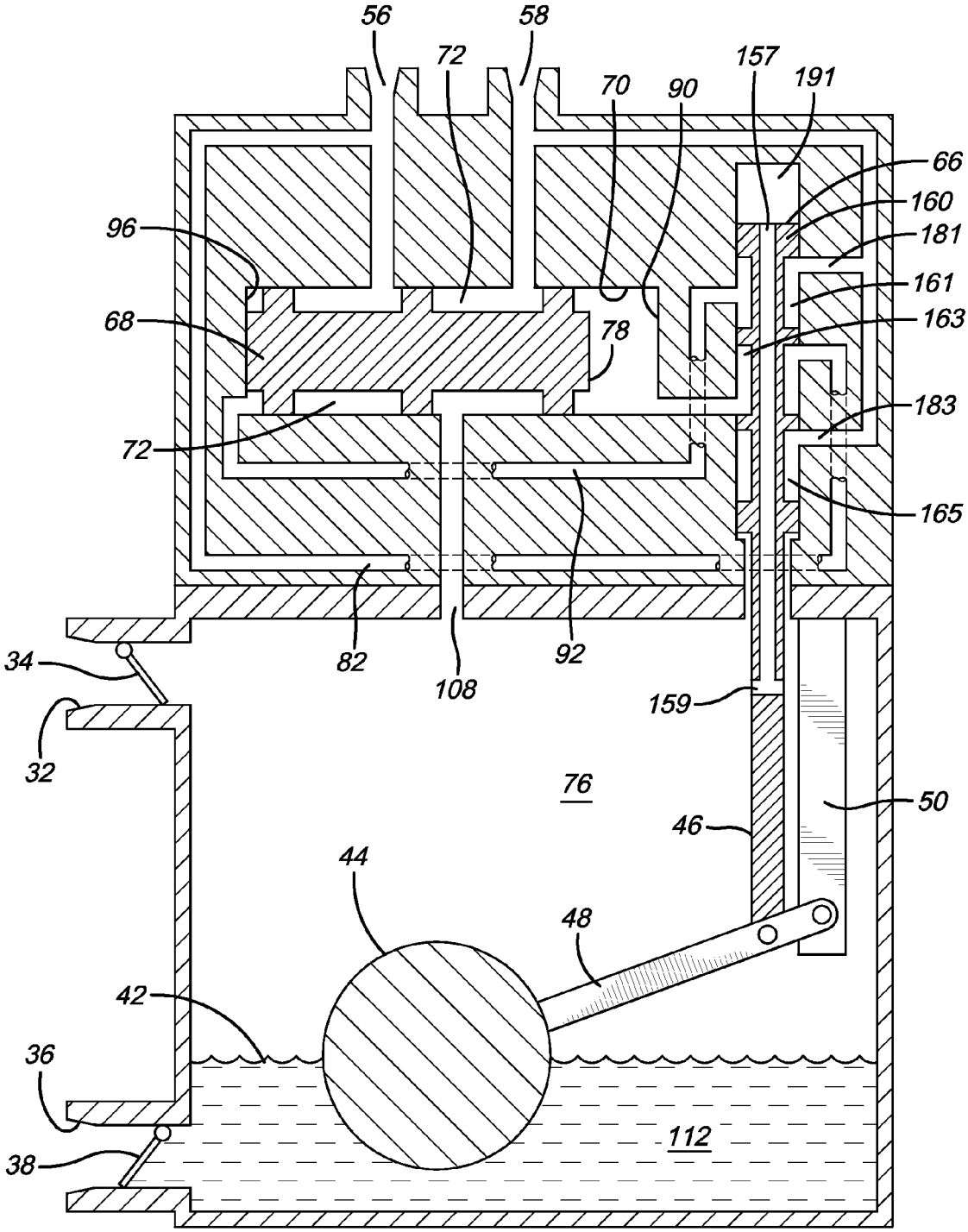
FIG. 8 depicts the condensate pump of the present invention at the low water level, FIG. 8A, at an intermediate water level, FIG. 8B, and at a high water level, 8C.

FIG. 8 depicts condensate pump of FIG. 7 in three different positions. In FIG. 8A, primary piston 160 is at second primary position 66 corresponding to a low water level in condensate reservoir 30. In this position 66, primary piston 160 is positioned so that upper recess 161 is positioned in primary cylinder so that first upper passage 181 is in communication with second branch pressure drive line 92, so that any gas in the drive line, or at second end 96 of secondary cylinder, may be vented to pressure vent 58. Second lower passage 183 is in communication with lower recess 165 of primary piston 160, but lower recess 165 in this second primary position 66 is isolated from communication with branch drives, so second lower passage 183 has no effect when primary piston 160 is in this position 66. Gas pressure from pressure source 56 through intermediate recess 163 and first branch pressure drive line 82 moves secondary piston 68 in secondary cylinder 70 to second secondary piston position 78, which in FIG. 8A is to the left. Gaseous fluid can pass from gas space 76 through non-vertical passages 159, into vertical aperture 157 and into space 191 above primary piston 160 so that gas in this space is at substantially the same pressure as gas in gas space 76.

Figure 8B:
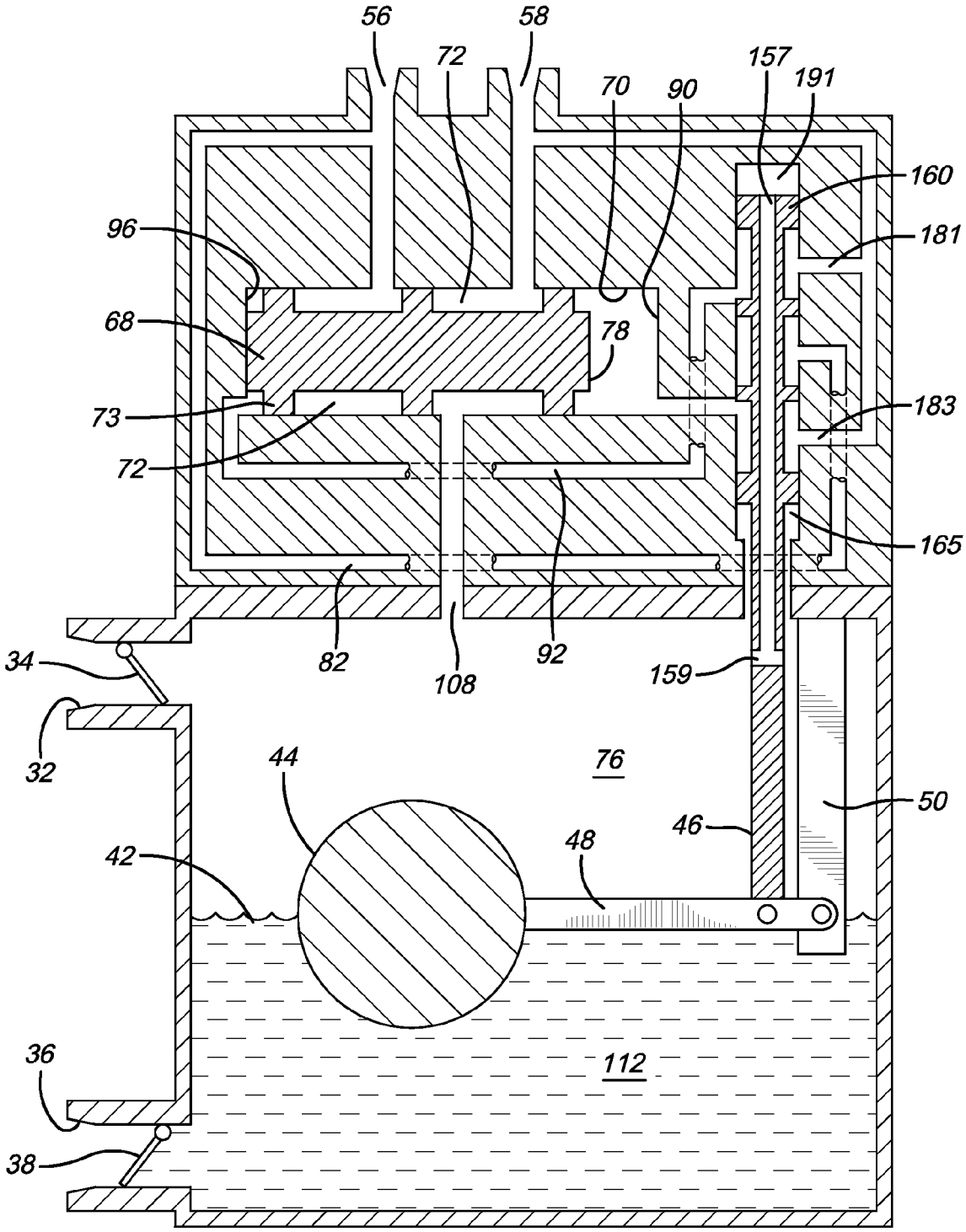
Figure 8C:
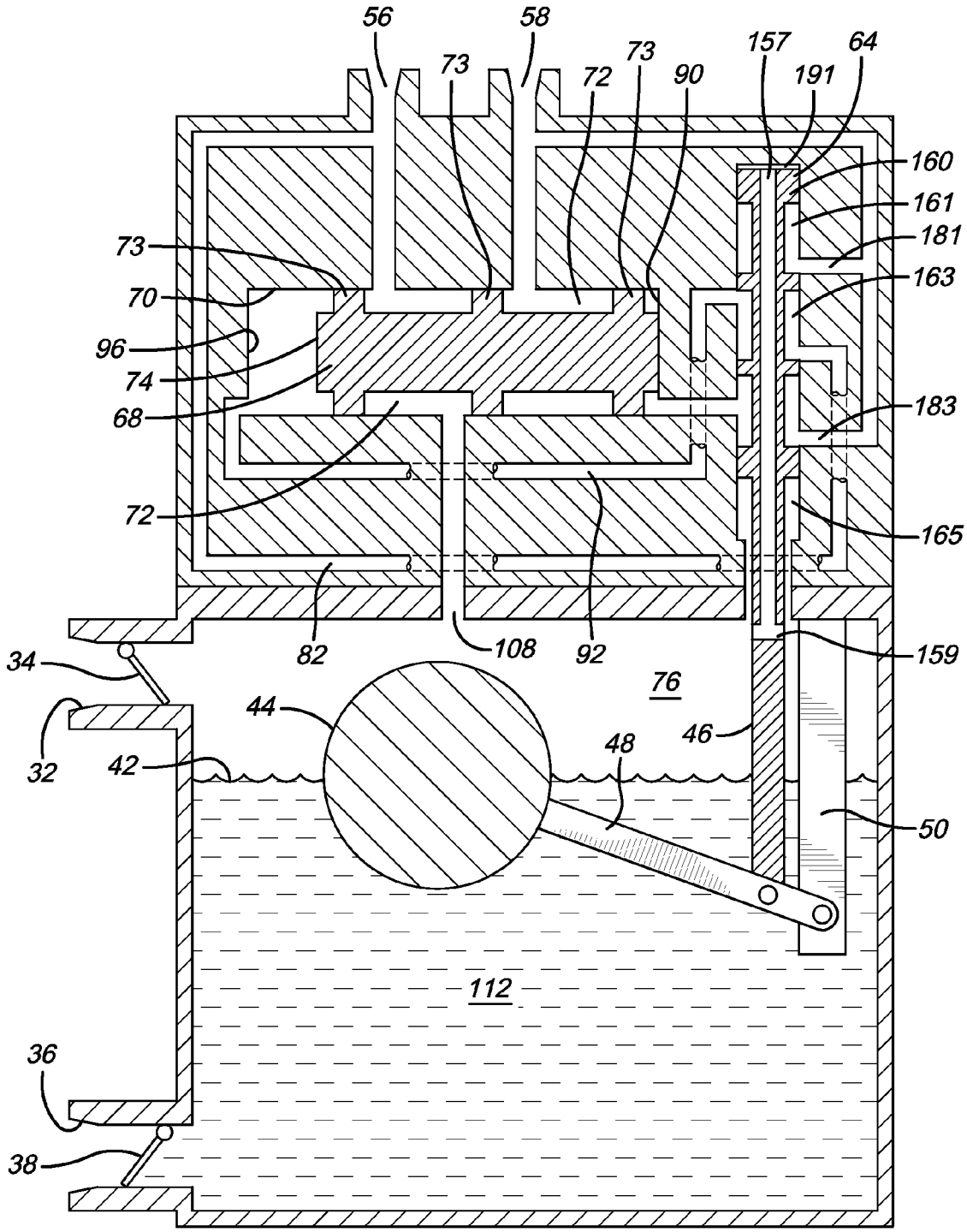

In FIG. 8B, as the water level rises to an intermediate level, primary piston 160 moves upward in primary cylinder 62. In this position, upper recess 161 remains positioned in primary cylinder 62 so that first upper passage 181 remains in communication with second branch pressure drive line 92. However, now primary position 160 has moved so that intermediate recess 163 and pressure source 56 are no longer in communication through main pressure drive line 82 to first end 90 of secondary cylinder 70. Furthermore, intermediate recess 163 has moved so that it is now in communication with second lower passage 183, thereby providing fluid communication from first end 90 of secondary cylinder, through intermediate recess 163 and second lower passage 183 to vent 58. This permit venting of first end 90 of secondary cylinder. Secondary piston 68 remains in second secondary piston position 78, as the venting through both first upper passage 181 and second lower passage 183 to either side of secondary piston 68 equalizes the pressure on both sides of secondary piston 68. Further, as primary piston 160 moves upward, pressure buildup of any gas in space 191 will be prevented since the gas will be displaced through vertical aperture 157 to gas space 76. This displaced gas will have little effect on fluid level because of its small volume. However, without fluid flow through vertical aperture 157, gas pressure otherwise would be increased in space 191, thereby resisting upward movement of primary piston 160.

In FIG. 8C, the fluid level in condensate level 30 has increased, resulting in float 44 rising, which in turn results in primary piston 160 moving upward into first primary piston position 64. Gas in space 191 moves through vertical aperture 157 so that gas pressure increases in space 191, which might otherwise resist upward movement of primary piston 160 in primary cylinder 62, are prevented. While upper recess 161 is in communication with pressure vent 58 through first upper passage 181, upper recess 161 is not in communication with any drive lines. Intermediate recess 163, however, is in communication with pressure source 56 through second branch drive line 92 which provides pressure to second end 96 of secondary cylinder 70, causing secondary piston 68 to move to the right in FIG. 8C. Simultaneously, lower recess 165 moves into communication with second lower passage 183 to provide a fluid path to pressure vent 58 so that gas is vented from the first end 90 of secondary cylinder, which gas would otherwise resist movement of secondary piston 68.

As the system moves in reverse, that is as primary piston 160 moves in primary cylinder from a first primary piston position 64 (up), as shown in FIG. 8C, to a second primary piston position 66 (down), as shown in FIG. 8A, gas from gas space 76 is provided to space 191 through vertical aperture 157 of primary piston 160. When primary position is moving in this direction up to down), this prevents suction from impeding the movement of primary piston 160 in primary cylinder 62. The arrangement also prevents gas from building up in primary cylinder 62 below the lowest ring 75 and lowest recess on primary piston 160, as gas is displaced in primary cylinder 62 below the lowest ring 175.

In this embodiment, the vertical aperture 157 through primary piston 160 eliminates the pressure effects of trapped gas in cylinder 62 on the piston as it moves in either direction and allow the primary piston 160 to move in reaction solely to the position of float 44 in response to liquid level 42 in condensate reservoir 30. The design always maintains one side of the secondary piston 68 at pressure of the vent when the opposite side is pressurized by pressure source 56, since one of passages 181, 183, is connected to pressure vent 58 through a recess 161, 163, 165 when piston 160 is positioned in a first or a second position (64, 66). This arrangement allows the system to operate and react at low operating pressures slightly above atmospheric pressures. This embodiment can effectively operate at pressures from about 5-20 psi.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A condensate pump, comprising:

a condensate reservoir having a fluid inlet, an inlet check valve operable to prevent a flow of fluid out of the condensate reservoir through the fluid inlet and to allow a flow of fluid into the condensate reservoir through the fluid inlet, a fluid outlet, and an outlet check valve operable to prevent a flow of fluid into the condensate reservoir through the fluid outlet and to allow a flow of fluid out of the condensate reservoir through the fluid outlet;

a liquid level sensor operable to sense a liquid level within the condensate reservoir; and a pressure/vent valve further comprising a primary piston slidably supported in a primary cylinder, wherein the primary piston slides in the primary cylinder responsive to the liquid level sensor, between a first primary piston position and a second primary piston position, the primary piston further including a vertical aperture extending from a first end of the piston to an opposite end of the piston, the opposite end in fluid communication with the condensate reservoir;

a pressure source, a pressure vent, a three-way valve further comprising a secondary piston slidably supported in a secondary cylinder, wherein the secondary piston slides in the secondary cylinder between a first secondary piston position in which the pressure source is in communication with a gas space of the condensate reservoir and the pressure vent is isolated from the gas space, and a second secondary piston position in which the pressure source is isolated from the gas space and the pressure vent is in communication with the gas space, and wherein the movement of the secondary piston in the secondary cylinder is responsive to movement of the primary piston in the primary cylinder.

2. The condensate pump of claim 1 wherein the primary piston further includes a plurality of rings forming a first outer diameter and a plurality of recesses having a second outer diameter, the second outer diameter being less than the first outer diameter.

3. The condensate pump of claim 2 wherein the primary piston further includes four rings, with three recesses extending between each pair of adjacent rings.

4. The condensate pump of claim 2 wherein the recesses form cavities when the primary piston is assembled into the primary cylinder.

5. The condensate pump of claim 4 further including a plurality of passages in communication with the pressure vent.

6. The condensate pump of claim 5 that includes three cavities and further includes two passages, a first passage that is in communication with a second end of the secondary cylinder and with the pressure vent through a first cavity when the primary piston is in a first position, while isolating a first end of the secondary cylinder from the pressure vent, thereby venting the second end of the secondary cylinder through the first cavity to the pressure vent, and a second passage that is in communication with the first end of the secondary cylinder and with the pressure vent through a second cavity when the primary piston is in a second position, while isolating the second end of the secondary cylinder from the pressure vent, thereby venting the first end of the secondary cylinder through the second cavity to the pressure vent.

7. The condensate pump of claim 1, wherein the pressure/vent valve is located exterior of the condensate reservoir while the primary piston that includes the vertical aperture extends into the condensate reservoir.

8. The condensate pump of claim 1, wherein the pressure/vent valve is located within the condensate reservoir.

9. The condensate pump of claim 1, further including a reservoir pressurization line extending from the pressure source to a first intermediate location of the secondary cylinder, a reservoir vent line extending from the vent to a second intermediate location of the secondary cylinder, and a pressurization/vent line extending from a third intermediate location of the secondary cylinder to the gas space of the condensate reservoir.

10. The condensate pump of claim 1, wherein the pressure/vent valve further includes the primary piston slidably supported in the primary cylinder, wherein the primary piston slides in the primary cylinder responsive to the liquid level sensor, between a first primary-piston position and a second primary-piston position, and wherein the secondary piston slides in the secondary cylinder responsive to a movement of the primary piston between the first and second positions.

11. The condensate pump of claim 10, further including a main pressure drive line extending from the pressure source to an intermediate location of the primary cylinder, a first branch pressure drive line extending from a first intermediate location of the primary cylinder to a first end of the secondary cylinder, and a second branch pressure drive line extending from a second intermediate location of the primary cylinder to a second end of the secondary cylinder.

12. A condensate pump, comprising:

a condensate reservoir comprising a fluid inlet, an inlet check valve operable to prevent a flow of fluid out of the condensate reservoir through the fluid inlet and to allow a flow of fluid into the condensate reservoir through the fluid inlet, a fluid outlet, and an outlet check valve operable to prevent a flow of fluid into the condensate reservoir through the fluid outlet and to allow a flow of fluid out of the condensate reservoir through the fluid outlet;

a liquid level sensor operable to sense a liquid level within the condensate reservoir, wherein the liquid level sensor comprises a float within the condensate reservoir, and an actuating arm connected to the float and movable with the float;

a pressure/vent valve located exterior to the condensate reservoir and comprising a primary piston slidably supported in a primary cylinder, wherein the primary piston slides in the primary cylinder responsive to the liquid level sensor, between a first primary piston position and a second primary piston position, the primary piston further including a vertical aperture extending from a first end of the piston to an opposite end of the piston, the opposite end in fluid communication with the condensate reservoir;

a pressure source, a pressure vent, a three-way valve further comprising a secondary piston slidably supported in a secondary cylinder, wherein the secondary piston slides in the secondary cylinder between a first secondary piston position in which the pressure source is in communication with a gas space of the condensate reservoir and the pressure vent is isolated from the gas space, and a second secondary piston position in which the pressure source is isolated from the gas space and the pressure vent is in communication with the gas space, and wherein the movement of the secondary piston in the secondary cylinder is responsive to movement of the primary piston in the primary cylinder;

a drive pressurization structure including a main pressure drive line extending from the pressure source to an intermediate location of the primary cylinder, a first branch pressure drive line extending from a first intermediate location of the primary cylinder to a first end of the secondary cylinder, and a second branch pressure drive line extending from a second intermediate location of the primary cylinder to a second end of the secondary cylinder; and a reservoir pressurization/vent structure including a reservoir pressurization line extending from the pressure source to a first intermediate location of the secondary cylinder, a reservoir vent line extending from the vent to a second intermediate location of the secondary cylinder, and a pressurization/vent line extending from a third intermediate location of the secondary cylinder to the gas space of the condensate reservoir.

13. The condensate pump of claim 12 wherein the primary piston further includes a plurality of rings forming a first outer diameter and a plurality of recesses having a second outer diameter, the second outer diameter being less than the first outer diameter.

14. The condensate pump of claim 13 wherein the primary piston further includes four rings, with three recesses extending between each pair of adjacent rings.

15. The condensate pump of claim 13 wherein the recesses form cavities when the primary piston is assembled into the primary cylinder.

16. The condensate pump of claim 15 further including a plurality of passages in communication with the pressure vent.

17. The condensate pump of claim 16 that includes three cavities and further includes two passages, a first passage that is in communication with a second end of the secondary cylinder and with the pressure vent through a first cavity when the primary piston is in a first position, while isolating a first end of the secondary cylinder from the pressure vent, thereby venting the second end of the secondary cylinder through the first cavity to the pressure vent, and a second passage that is in communication with the first end of the secondary cylinder and with the pressure vent through a second cavity when the primary piston is in a second position, while isolating the second end of the secondary cylinder from the pressure vent, thereby venting the first end of the secondary cylinder through the second cavity to the pressure vent.

18. The condensate pump of claim 12, wherein the pressure/vent valve is located exterior of the condensate reservoir while the primary piston that includes the vertical aperture extends into the condensate reservoir.

19. The condensate pump of claim 12, wherein the pressure/vent valve is located within the condensate reservoir.

20. The condensate pump of claim 12, wherein the pressure/vent valve further includes the primary piston slidably supported in the primary cylinder, wherein the primary piston slides in the primary cylinder responsive to the liquid level sensor, between a first primary-piston position and a second primary-piston position, and wherein the secondary piston slides in the secondary cylinder responsive to a movement of the primary piston between the first and second positions.

21. The condensate pump of claim 20, further including a main pressure drive line extending from the pressure source to an intermediate location of the primary cylinder, a first branch pressure drive line extending from a first intermediate location of the primary cylinder to a first end of the secondary cylinder, and a second branch pressure drive line extending from a second intermediate location of the primary cylinder to a second end of the secondary cylinder.

* * * * *